US005456271A

United States Patent [19]

Legette

[11] Patent Number: 5,456,271

[45] Date of Patent: Oct. 10, 1995

[54] HAIR BEADING TOOL

[76] Inventor: Loretha Legette, 2702 Ellington Cir., Nashville, Tenn. 37211

[21] Appl. No.: 185,203

[22] Filed: Jan. 24, 1994

[51] Int. Cl.[6] ..... A45D 7/02

[52] U.S. Cl. ..... 132/212; 132/200

[58] Field of Search ..... 132/212, 270, 132/273, 330, 332, 200; 66/117, 118; 606/148, 139, 144, 205, 208, 206; 219/143, 129; 43/4, 4.5, 53.5; 269/6

[56] References Cited

U.S. PATENT DOCUMENTS

| | | | |
|---|---|---|---|
| 2,688,816 | 9/1954 | Bondesen | 43/53.5 |
| 3,295,535 | 1/1967 | Amato | 132/212 |
| 3,451,157 | 6/1969 | Jones | 43/53.5 |
| 3,588,078 | 6/1971 | Van De Sande | 269/6 |
| 4,590,702 | 5/1986 | Chestnutt | 43/53.5 |
| 4,961,439 | 10/1990 | Hartmann | 132/212 |
| 5,300,082 | 4/1994 | Sharpe | 606/147 |

*Primary Examiner*—John G. Weiss
*Attorney, Agent, or Firm*—Katherine McGuire

[57] ABSTRACT

A tool for applying beads to gathered strands of braided or unbraided hair comprises an elongated cylinder attached at a first end thereof to a handle with an elongated rod telescopically and slidingly inserted within the cylinder. The rod includes a hooked end which lies adjacent the free end of the cylinder. A lever is attached to the opposite end of the rod and is used to move the rod between extended and retracted positions with respect to the cylinder with the hooked end of the rod lying exteriorly and interiorly of the cylinder, respectively. The beads are first mounted in concentric relationship to the cylinder. With the rod moved to the extended position, the end of the braid is hooked and the lever is released which retracts the rod and pulls the end of the braid into the cylinder. The beads are then pushed off the cylinder and onto the braid. Pressing the lever causes the rod to again extend which releases the braid.

4 Claims, 1 Drawing Sheet

HAIR BEADING TOOL

BACKGROUND OF THE INVENTION

This invention relates to hair styling implements and, more particularly, to a hand-operated hair styling tool for applying beads to braided or unbraided gatherings of hair.

It is presently a popular hair styling technique to braid hair in small gatherings, and then to apply a plurality of colorful beads in longitudinally adjacent relationship on each braid. Heretofore, the beads were applied manually, one at a time, by inserting the end of the braid through the center of the bead and pushing the bead to a desired location on the braid. This is a time-consuming task, especially so if there are many braids and it is desired to apply a maximum amount of beads to each braid.

SUMMARY OF THE INVENTION

It is therefore a principal object of the present invention to provide a hair styling tool which is used to apply beads to either braided or unbraided strands of hair.

It is a further object of the present invention to provide a hair styling tool for applying beads to hair which can apply a multiple number of beads at a time to a single gathering of hair.

It is another object of the present invention to provide a hair styling tool of the above type which is quick and simple to operate.

It is still a further object of the present invention to provide a tool which can be used in arts and crafts to apply beads to any flexible, elongated strip of material in a quick and efficient manner.

Other objects will in part be obvious and in part appear hereinafter.

DETAILED DESCRIPTION

Figure 1:
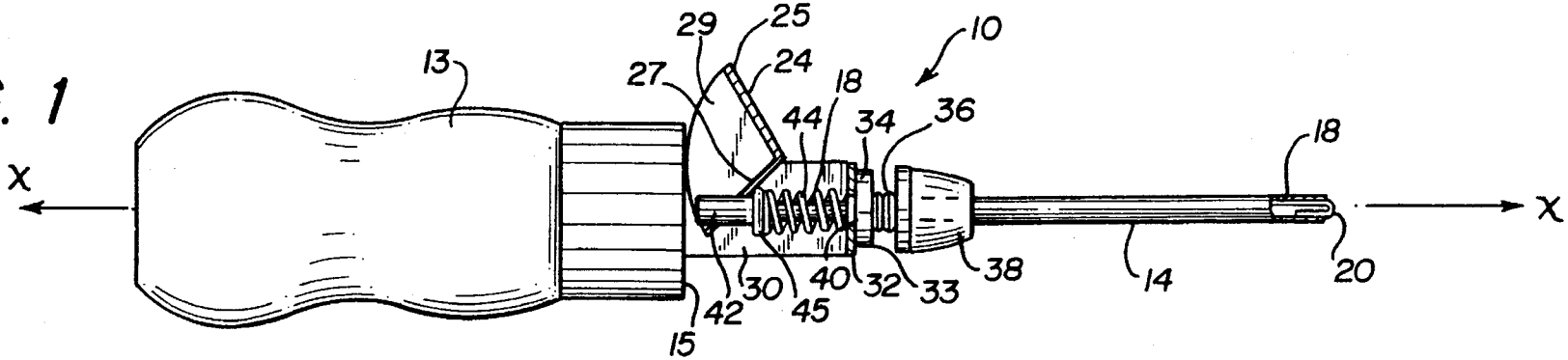
FIG. 1 is a side, elevational view of the hair beading tool with the hair grasping hook in its retracted position with selected portions of the tool shown in section.
Figure 2:
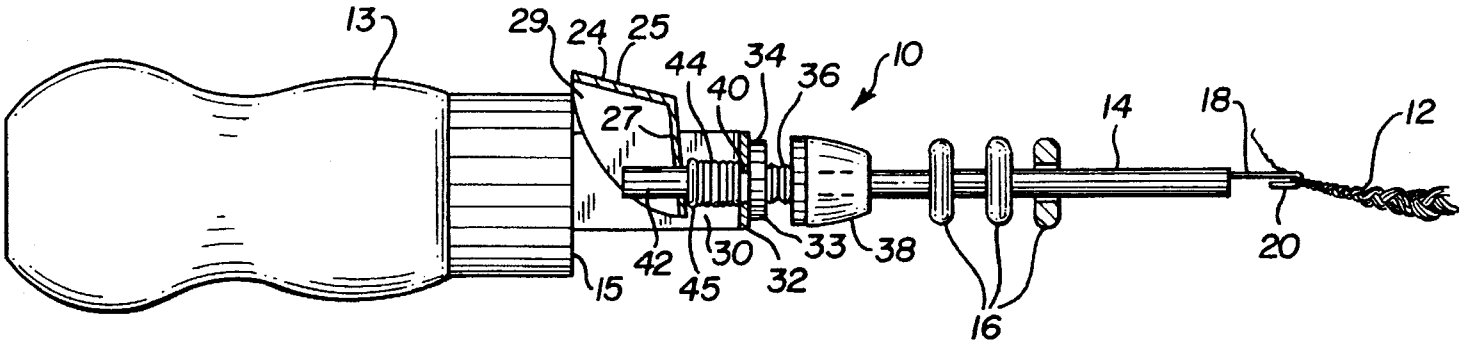
FIG. 2 is the view of FIG. 1 shown with three hair beads mounted to the elongated cylinder portion thereof (one of the beads shown in cross-section), and with the hair grasping hook moved to its extended position with the hooked end thereof grasping the tail end of a braid in the intended manner.
Figure 3:
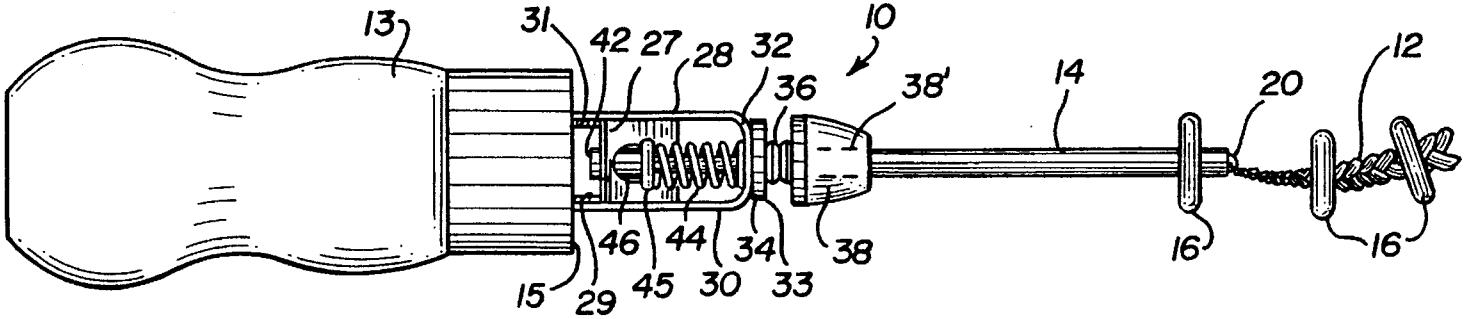
FIG. 3 is the view of FIG. 2 with the tool rotated 90°, the hair grasping hook in the retracted position, and the beads in the process of being fed onto the braid of hair.

Referring now the drawings, there is seen in FIGS. 1–3 a tool 10 which is used to apply beads to an unbraided or braided gathering of hair 12. It will be evident that tool 10 can also be used in the arts and craft art to apply beads to virtually any elongated strip of material (e.g., fringe). Generally speaking, tool 10 includes a fixed, elongated cylinder 14 having a central opening extending the full longitudinal length thereof, and onto which are fed, in concentric relationship thereto, a plurality of circular, donut-shaped hair beads 16 each having a center circular opening. A movable, elongated rod 18 having a hooked end 20 is telescopically and slidingly positioned within cylinder 14 and extends therebeyond to a position adjacent handle 13. A lever 24 is provided which, when pressed, moves rod 18 to the extended position seen in FIG. 2. When in this extended position, the hooked end 20 of rod 18 extends outwardly of cylinder 14 and is used to grasp the tail end of the braid 12. The user then releases lever 24 which retracts rod 18 and the hooked end 20 thereof into cylinder 14 bringing the tail end of braid 12 along with it into cylinder 14 as seen in FIG. 3. The beads 16 may then be easily slid off of cylinder 14 and onto the braid 12. Lever 24 is then pressed again which extends rod 18 to release braid 12.

More specifically, a U-shaped mounting bracket 26 is provided having first and second legs 28 and 30 attached to handle end 15 with interconnecting wall 32 lying spaced therefrom in a plane perpendicular to the longitudinal axis x—x of tool 10.

Cylinder 14 is fixedly attached to the interconnecting wall 32 of mounting bracket 26, extending along longitudinal axis x—x which also extends through handle 13. Means fixedly attaching cylinder 14 to bracket 26 comprise a bolt 33 having a head portion 34 and a threaded shank 36 with head portion 34 fixedly anchored to interconnecting wall by appropriate means (e.g., cementing, welding, etc.). A bore hole extends longitudinally through head portion 34 and shank 36 wherethrough rod 18 extends. A nut element 38 which also includes a central, longitudinal bore 38' is provided which is threadedly secured to threaded shank 36 at a first end thereof. The end of cylinder 14 located opposite rod hooked end 20 is inserted into the opposite end of nut element 38 and is securely held therein (e.g., by friction, cementing, welding or engaging threads). Bolt 33, nut element 38 and cylinder 14 are all concentrically aligned with a circular aperture 40 formed in the bracket interconnecting wall 32. Since nut element 38 is removable from bolt 33, it may be exchanged with other nut elements similar to element 38, yet carrying a cylinder of an alternate diameter. This may be desirable when using different sized beads having openings of varying diameters.

As mentioned above, the elongated rod 18 is telescopically positioned within cylinder 14 and extends longitudinally through bolt 33, nut element 38 and aperture 40 to a position between bracket legs 28 and 30. This end of rod 18 (which is located opposite hooked end 20) attaches to a rod piece 42 of increased diameter. A spring 44 is disposed on rod 18 between a flange 45 fixedly attached to the end of rod piece 42, and interconnecting wall 32, biasing rod 18 in the retracted position with rod piece 42 located adjacent handle end 15 and hooked end 20 located within cylinder 14 (FIG. 1).

Lever 24 is seen to comprise first and second, rectangular walls 25 and 27, respectively, disposed at an obtuse angle to each other and including wedge-shaped side walls 29 and 31 extending therebetween. The width of walls 25 and 27 is slightly smaller than the distance between bracket legs 28 and 30 such that lever 24 may be positioned therebetween. As seen best in FIG. 3, second wall 27 includes a centrally located aperture 46 wherethrough rod piece 42 extends with the curved edges of side walls 29 and 31 abutting handle end 15. With spring 44 in the expanded position as seen in FIG. 1, the first lever wall 25 extends outwardly of bracket legs 28 and 30. Using the thumb of the hand holding handle 14, the user presses upon first lever wall 25 which causes second lever wall 27 to bear upwardly against flange 45 thereby pushing rod 18 into its extended position and compressing spring 44 against interconnecting wall 32. With rod 18 in its fully extended position, hooked end 20 thereof is exposed to grasp the tail end of braid 12 as explained previously. Lever 24 is then released which causes spring 44 to expand and bias rod 18 into its retracted position, pulling the tail end of braid 12 into cylinder 14. As seen in FIG. 3, the beads 16 on cylinder 14 may then be easily slid off of cylinder 14 and onto the braid 12. Pushing lever 24 a second time extends hook 20 to release braid 12.

It may thus be realized that there is provided a novel and unique hair styling tool to quickly and easily apply beads to gatherings of either braided or unbraided hair, or indeed any elongated strand of material. Also, although the invention has been described in relation to a preferred embodiment thereof, various modifications may be made without departing from the full spirit and scope of the invention as is defined by the claims which follow.

What is claimed is:

1. A hair styling tool for applying a plurality of beads each having a central opening to gathered strands of braided or unbraided hair, said tool comprising:

a) a handle portion for manually grasping said tool;

b) an elongated cylinder having longitudinal axis and a central, longitudinal bore extending between first and second, opposite and open ends, said cylinder having a substantially constant outer diameter;

c) means attaching said cylinder second end to said handle whereby said plurality of beads may be removably mounted to said cylinder in concentric relationship thereto by inserting said cylinder first end through said central opening of said beads;

d) an elongated rod having first and second, opposite ends with said first end of said rod being hooked, said rod being telescopically and slidingly positioned within said longitudinal bore of said cylinder with said first end of said rod located adjacent said first end of said cylinder; and e) means for selectively moving said rod within and with respect to said cylinder between a retracted position wherein said first end of said rod is positioned inside said cylinder, to an extended position wherein said first end of said rod is positioned exteriorly of said cylinder, said rod moving means comprising a lever attached to said rod second end;

f) an annular flange attached to and encircling said rod adjacent said second end thereof, said lever being positioned and operable to bear against said flange when moving said rod to said extended position;

g) a U-shaped bracket having first and second legs with an interconnecting wall extending therebetween, said interconnecting wall including a centrally located aperture formed therethrough, said first and second legs being attached to said handle portion with said interconnecting wall lying spaced therefrom in a plane perpendicular to the longitudinal axis of said tool defined by said cylinder, said cylinder second end being mounted to said interconnecting wall with said longitudinal bore thereof being in concentric alignment with said aperture in said interconnecting wall, said rod extending through said aperture with said rod second end lying between said bracket first and second legs.

2. The invention according to claim 1 and further comprising a spring disposed on said rod between said annular flange and said interconnecting wall.

3. A method for applying a plurality of beads to gathered strands of hair, said method comprising the steps of:

a) removably feeding said beads onto an elongated cylinder having a central, longitudinally extending bore hole and a first, open end;

b) extending a rod having a first, hooked end inside said cylinder bore with said first, hooked end extending exteriorly adjacent to said first, open end of said cylinder;

c) grasping a free end of said gathered strands of hair with said hooked end;

d) moving said rod inside said cylinder to retract said hooked end with said free end of gathered strand of hair interiorly adjacent to said first, open end of said cylinder whereby said gathered strand extends in co-extensive relation to said cylinder;

e) moving said beads off from said cylinder and onto said co-extensive gathered strands of hair; and f) moving said rod within said cylinder to extend said hooked end exteriorly adjacent said first, open end of said cylinder and release said gathered strand of hair.

4. The method of claim 3 wherein said cylinder is of a substantially constant outer diameter.

* * * * *